US012571289B2

(12) United States Patent
Liu et al.

(10) Patent No.: US 12,571,289 B2
(45) Date of Patent: Mar. 10, 2026

(54) TOPOLOGICAL WELLBORE DESIGN

(71) Applicant: Schlumberger Technology Corporation, Sugar Land, TX (US)

(72) Inventors: Qing Liu, Beijing (CN); Peng Jin, Beijing (CN); Lu Jiang, Beijing (CN); Wang JiaJun, Beijing (CN); Paul Bolchover, Beijing (CN); Samba Ba, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/541,044

(22) Filed: Dec. 15, 2023

(65) Prior Publication Data

US 2024/0200429 A1 Jun. 20, 2024

Related U.S. Application Data

(60) Provisional application No. 63/387,989, filed on Dec. 19, 2022.

(51) Int. Cl.
*E21B 43/16* (2006.01)

(52) U.S. Cl.
CPC ..... *E21B 43/16* (2013.01); *E21B 2200/20* (2020.05)

(58) Field of Classification Search
CPC ..... E21B 43/16; E21B 2200/20; E21B 47/02; E21B 47/022
See application file for complete search history.

(56) References Cited

U.S. PATENT DOCUMENTS 12,270,282 B2 * 4/2025 Bergey ..... E21B 41/00
2007/0199721 A1 * 8/2007 Givens ..... G06Q 10/06 166/382

(Continued)

FOREIGN PATENT DOCUMENTS

WO 2012102784 A1 8/2012

OTHER PUBLICATIONS

Emerick, Alexandre A., Eugênio Silva, Bruno Messer, Luciana F. Almeida, Dilza Szwarcman, Marco Aurélio C. Pacheco, and Marley MBR Vellasco. "Well placement optimization using a genetic algorithm with nonlinear constraints." In SPE Reservoir Simulation Conference, pp. SPE-118808. SPE, 2009. 20 Pages. (Year: 2009).*

(Continued)

*Primary Examiner* — Eunhee Kim
(74) *Attorney, Agent, or Firm* — Jeffery D. Frantz

(57) ABSTRACT

A method and system for finding and efficiently evaluating and selecting a wellbore path that accounts for placement rules and the presence of existing wells. A topological representation of the connected paths is created and managed. The topological representation may be generated as a pre-computed database of space information that represents the locations of existing wells and accounts for restrictions such as anti-collision and the parameters, including geological and drilling equipment parameters. Using such a representation, the design of a wellbore path may be completed quickly and more efficiently. The topology may represent all connected space for a section of the subsurface. This topological representation may be used to evaluate all possible paths from the starting point (surface location, tie-in point for a sidetrack, tie-in point for replanning, etc.) to the target and enable selecting the path that meets the conditions and is optimized for the existing constraints.

18 Claims, 6 Drawing Sheets

(56) References Cited

U.S. PATENT DOCUMENTS

| | | | | |
|---|---|---|---|---|
| 2013/0140037 | A1* | 6/2013 | Sequeira, Jr. | E21B 7/04 703/10 |
| 2015/0120255 | A1* | 4/2015 | King | E21B 43/00 703/2 |
| 2016/0011332 | A1* | 1/2016 | AlQahtani | G06F 30/20 703/10 |
| 2016/0194949 | A1* | 7/2016 | Dirksen | E21B 43/305 702/9 |
| 2018/0038204 | A1* | 2/2018 | Khan | E21B 7/04 |
| 2018/0051552 | A1* | 2/2018 | Li | E21B 47/024 |
| 2019/0376379 | A1* | 12/2019 | Ramjit | E21B 47/002 |
| 2021/0180439 | A1* | 6/2021 | Rawlinson | G06N 5/01 |
| 2021/0208304 | A1* | 7/2021 | Manzoor | G01V 20/00 |
| 2021/0405248 | A1* | 12/2021 | Cancelliere | G01V 20/00 |

OTHER PUBLICATIONS

Hoeink T, Cotrell D, Ghorpade S. You can plan the most productive well path and drill it, too. InOffshore Technology Conference May 4, 2020 (p. D031S033R002). OTC. 9 Pages. (Year: 2020).*

Biswas, K. et al., "Uncertainty handling in wellbore trajectory design: a modifed cellular spotted hyena optimizer based approach", Journal Of Petroleum Exploration And Production Technology, 2022, 12(10), pp. 2643-2661.

Herrera, A. et al., "Geomechanically-Constrained Wellpath Design: The Stability vol. Concept", SPE 136189, presented at the SPE 2009 Annual Technical Conference and Exhibition, 12 pages.

International Search Report and Written Opinion of PCT Application No. PCT/US2023/084153, mailed Apr. 22, 2024.

* cited by examiner

TOPOLOGICAL WELLBORE DESIGN

CROSS-REFERENCE TO RELATED APPLICATIONS

This application claims priority to U.S. Provisional Patent Application No. 63/387,989, filed on Dec. 19, 2022, which is incorporated herein by reference in its entirety.

BACKGROUND

Finding a drillable path for a well may be challenging, particularly when the subsurface is occupied with existing wells. This may be a particular challenge when finding drillable re-entry paths in developed fields.

Conventionally, finding a new candidate wellbore path from a starting point (such as a tie-in point) is done manually by iteration, with the team constantly evaluating and looking for free space in which to plan the well. The time also accounts for collision risks and other drilling constraints such as drilling difficulty. Trying to find a drillable wellbore path that minimizes collision risk and satisfies other restrictions is time consuming and prone to errors.

SUMMARY

Disclosed herein is an approach to finding, efficiently evaluating and selecting a wellbore path that accounts for placement rules and takes into account the presence of existing wells. In one embodiment, a topological representation of the connected paths is created and managed. The topological representation may be generated as a pre-computed database of space information that represents the locations of existing wells and accounts for restrictions such as anti-collision. Using such a representation, the design of a wellbore path may be completed quickly and more efficiently. The topology may represent all connected space for a section of the subsurface. This topological representation may be used to evaluate all possible paths from the starting point (surface location, tie-in point for a sidetrack, tie-in point for replanning, etc.) to the target and enable selecting the path that meets the conditions and is optimized for the existing constraints.

One aspect of the present disclosure is directed to a method comprising generating a representation of a three-dimensional volume ("3D volume") comprising a plurality of cells, wherein a portion of the 3D volume is below a surface, and data for each cell of the plurality of cells comprising a cell volume and a unique location of each cell within the 3D volume designated by three location parameters. One of the location parameters represents a depth layer relative to the surface and the other two parameters define a grid that divides the depth layer into two-dimensional pieces. The method includes identifying one or more existing wellbores within the 3D volume by listing as occupied cells those of the plurality of cells in the 3D volume which are associated with the existing wellbores. The method also includes computing an unoccupied envelope homology group, wherein occupied cells are excluded from the unoccupied envelope homology group. The method additionally includes performing a first topological deformation retraction to find a 2D unoccupied envelope in a 2D space homologically equivalent to the unoccupied envelope homology group in the 3D volume and performing a deformation retraction of the unoccupied envelope homology group. The method further includes performing a second topological deformation retraction to get a simplified graph retract that may be mapped back to the 3D volume and determining one or more candidate wellbore paths utilizing the simplified graph retract.

The above-described method's identification of existing wellbores by listing occupied cells may include listing the unique location of the occupied cell; a wellbore direction of the occupied cell and an uncertainty value of cells adjacent the occupied cell, further wherein computing the unoccupied envelope homology group includes excluding from the unoccupied envelope homology group cells having uncertainty value above a threshold uncertainty value. This method may also include assigning supplemental information to a portion of the plurality of cells in the 3D volume, wherein the supplemental information includes one or more of geological layer information; geological composition information; geological feature information; reservoir information; reservoir adjacent information; petrophysical feature information; geo-mechanical feature information; and steering tendency feature information. Further, the method may include obtaining one or more candidate starting locations for a candidate wellbore path; and obtaining one or more candidate target locations for the candidate wellbore path, wherein the candidate starting locations and the candidate target locations may be static when determining the candidate wellbore paths or may be dynamic in real-time when determining the candidate wellbore paths. In addition, performing the first topological deformation retraction further comprises the unoccupied envelope homology group, data for the cells, existing wellbore identification, candidate starting location, candidate target location, and supplemental information. Determining the candidate wellbore paths may include applying one or more placement rules to each candidate wellbore path, the method further comprising: determining a path score for each candidate wellbore path; selecting the candidate wellbore path having the highest path score; and performing a wellsite action in response to the selected candidate wellbore path.

The method may also include obtaining a set of drilling equipment parameters comprising downhole steering tool parameters, drilling assembly parameters and steering tendency capacity parameters, wherein determining the candidate wellbore paths includes utilizing at least one of the drilling equipment parameters.

Determining the candidate wellbore paths in the method may include applying one or more placement rules to each candidate wellbore path, the method further comprising: determining a path score for each candidate wellbore path; selecting the candidate wellbore path having the highest path score; and performing a wellsite action in response to the selected candidate wellbore path.

In another aspect of the present disclosure, a method includes generating a three-dimensional representation of a volume ("3D volume"), a portion of which is below a surface, comprising a plurality of cells and data for each cell of the plurality of cells comprising a cell volume and a unique location of each cell within the 3D volume designated by three location parameters; identifying one or more existing wellbores within the 3D volume by listing as occupied cells those of the plurality of cells in the 3D volume associated with the existing wellbore; assigning supplemental information to a portion of the plurality of cells in the 3D volume; generating a 3D unoccupied envelope around and excluding the occupied cells with an initial size of cells; discretizing each cell contained in the 3D unoccupied envelope into a set of cell sizes smaller than the initial size of the cells; repeating the generation of the 3D unoccupied envelope until the resolution of the 3D unoccupied envelope satisfies a predetermined precision threshold; performing a first topological deformation retraction to find a 2D unoccupied envelope in a 2D space homologically equivalent to the 3D unoccupied envelop; performing a deformation retraction of the unoccupied envelope 3D volume based upon the first topological deformation retraction; performing a second topological deformation retraction to obtain a simplified graph retract that is configured be mapped back to the 3D volume; and determining one or more candidate wellbore paths utilizing at least one of the simplified graph retract, data for the cells, existing wellbore data, candidate starting locations, candidate target locations, drilling equipment parameters, supplemental information and homology group, A set of input data to the first topological deformation retraction for the method may include at least one of data for the cells, existing wellbore identification, and supplemental information. This method may further comprise obtaining one or more candidate starting locations for a candidate wellbore path; obtaining one or more candidate target locations for the candidate wellbore path; computing an unoccupied envelope homology group comprising a list of cell locations, wherein either; the unoccupied envelope homology group is the plurality of cells in the 3D volume other than the occupied cells; or the unoccupied envelope homology group is the plurality of cells in the 3D volume of uncertainty value below a threshold uncertainty; wherein the set of input data to the first topological deformation retraction includes at least one of the candidate starting location, the candidate target location, and the unoccupied envelope homology group. Further to this method, determining the candidate wellbore paths may include applying one or more placement rules to each candidate wellbore path and the method further includes: determining a path score for each candidate wellbore path; displaying each candidate wellbore path and corresponding path score; selecting the candidate wellbore path having the highest path score; and performing a wellsite action in response to the selected candidate wellbore path. Further to this method, identifying existing wellbores may be done by listing occupied cells includes listing the unique location of the occupied cell; a wellbore direction of the occupied cell and an uncertainty value of cells adjacent the occupied cell, further wherein computing the unoccupied envelope homology group includes excluding from the unoccupied envelope homology group cells having uncertainty value above a threshold uncertainty value. Also, the supplemental information may comprise one or more of geological layer information; geological composition information; geological feature information; reservoir and reservoir adjacent information; petrophysical feature information; geo-mechanical feature information; and steering tendency feature information. In this method, generating the 3D unoccupied envelope may include cither: selecting the plurality of cells in the 3D volume other than the occupied cells; or selecting the plurality of cells in the 3D volume of uncertainty value below a threshold uncertainty. The method may also involve obtaining a set of drilling equipment parameters comprising downhole steering tool parameters, drilling assembly parameters and steering tendency capacity parameters, wherein determining the candidate wellbore paths includes utilizing at least one of the drilling equipment parameters.

In another aspect of the present disclosure, a method includes generating a three-dimensional representation of a volume ("3D volume"), a portion of which is below a surface, comprising a plurality of cells and data for each cell of the plurality of cells; the date may include a cell volume; and a unique location of each cell within the 3D volume designated by three location parameters, wherein one of the location parameters represents a depth layer relative to the surface, and the other two parameters define a grid that divides the depth layer into two-dimensional pieces. The method may involve identifying one or more existing wellbores within the 3D volume by listing as occupied cells those of the plurality of cells in the 3D volume associated with the existing wellbore. The identifying information for each occupied cell may include a location of the occupied cell; a wellbore direction of the occupied cell; and an uncertainty value of the occupied cell. The method also includes assigning supplemental information to a portion of the plurality of cells in the 3D volume, the supplemental information comprising one or more of geological layer information; geological composition information; geological feature information; reservoir and reservoir adjacent information; petrophysical feature information; geo-mechanical feature information; and steering tendency feature information. The method includes generating a 3D unoccupied envelope around the occupied cells with an initial size of cells; discretizing each cell contained in the 3D unoccupied envelope into a set of cell sizes smaller than the initial size of the cells; repeating the generation of the 3D unoccupied envelope until the resolution of the 3D unoccupied envelope satisfies a predetermined precision threshold; obtaining one or more candidate starting locations for a candidate wellbore path, wherein the starting location is static or dynamic in real-time; obtaining one or more candidate target locations for the candidate wellbore path, wherein the target locations is static or dynamic in real-time; obtaining a set of drilling equipment parameters comprising downhole steering tool parameters, drilling assembly parameters and steering tendency capacity parameters; computing an unoccupied envelope homology group comprising a list of cell locations, wherein either the unoccupied envelope homology group is the plurality of cells in the 3D volume other than the occupied cells or the unoccupied envelope homology group is the plurality of cells in the 3D volume of uncertainty value below a threshold uncertainty; performing a first topological deformation retraction to find a 2D unoccupied envelope in a 2D space homologically equivalent to the 3D volume utilizing the unoccupied envelope homology group, data for the cells, mapped wellbore data, candidate starting location, candidate target location, and supplemental information. The method may also include performing a deformation retraction of the unoccupied envelope 3D volume based upon the first topological deformation retraction; performing a second topological deformation retraction to obtain a simplified graph retract that is configured be mapped back to the 3D volume. The method may also comprise determining one or more candidate wellbore paths utilizing the simplified graph retract, data for the cells, existing wellbore data, candidate starting locations, candidate target locations, drilling equipment parameters, supplemental information and homology group, wherein determining the candidate wellbore paths includes applying one or more placement rules to each candidate wellbore path. A path score may be determined for each candidate wellbore path and each candidate wellbore path and corresponding path score may be displayed prior to selecting the candidate wellbore path having the highest path score and performing a wellsite action in response to the selected candidate wellbore path.

This summary introduces some of the concepts that are further described below in the detailed description. Other concepts and features are described below. The claims may include concepts in this summary or other parts of the description.

BRIEF DESCRIPTION OF THE DRAWINGS

The figures below are not necessarily to scale; dimensions may altered to help clarify or emphasize certain features.

DETAILED DESCRIPTION

Introduction

Figure 1:
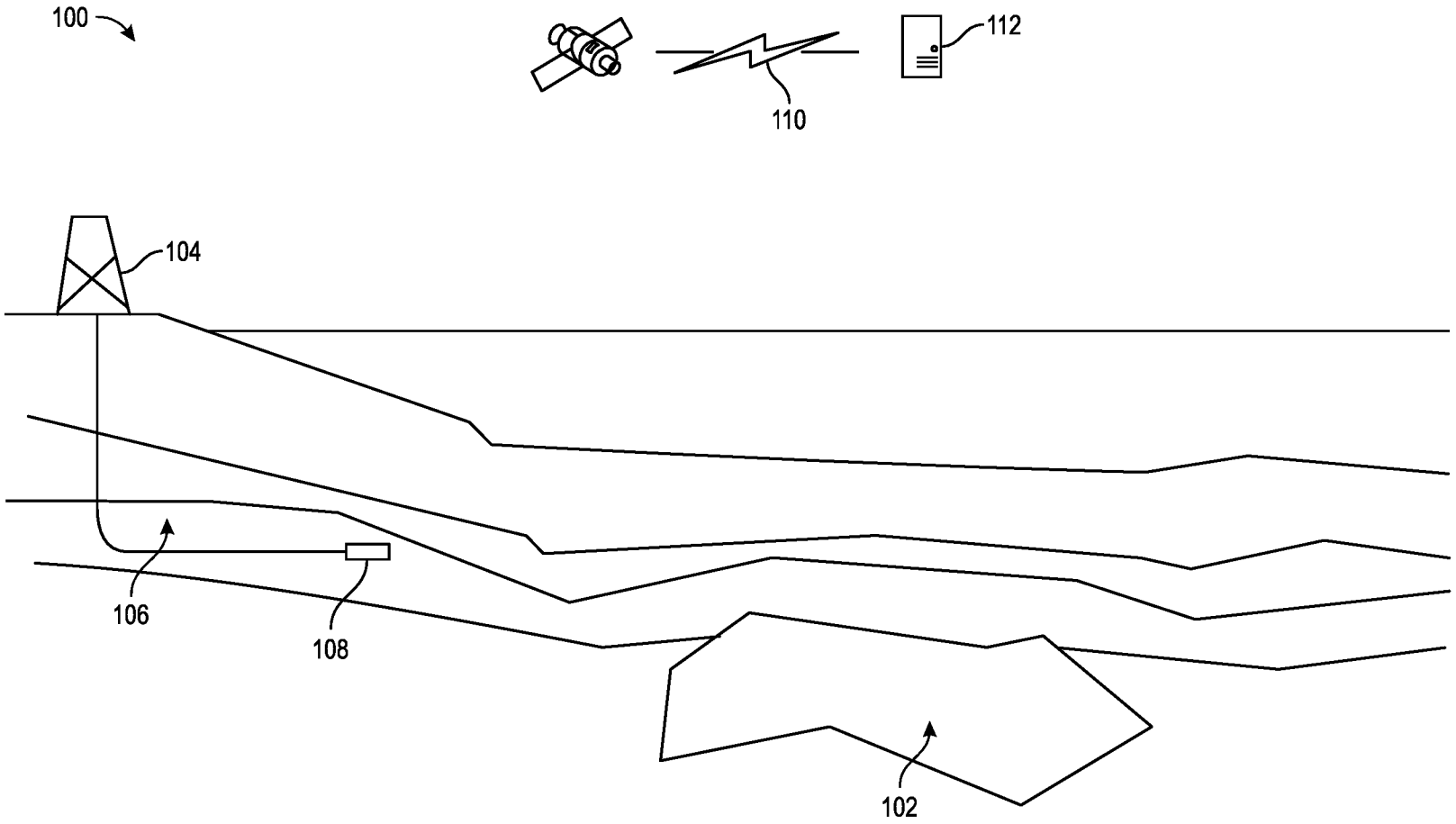
FIG. 1 illustrates an example of an environment in which drilling may take place.

The following detailed description refers to the accompanying drawings. Wherever convenient, the same reference numbers are used in the drawings and the following description to refer to the same or similar parts. While several embodiments and features of the present disclosure are described herein, modifications, adaptations, and other implementations are possible, without departing from the spirit and scope of the present disclosure.

Although the terms "first", "second", etc. may be used herein to describe various elements, these terms are used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Embodiments

FIG. 1 illustrates one example of an environment 100 in which drilling may occur. The environment may include a reservoir 102 and various geological features, such as stratified layers. The geological aspects of the environment 100 may contain other features such as faults, basins, and others. The reservoir 102 may be located on land or offshore.

The environment 100 may be outfitted with sensors, detectors, actuators, etc. to be used in connection with the drilling process. FIG. 1 illustrates equipment 104 associated with a well 106 being constructed using downhole equipment 108. The downhole equipment 108 may be, for example, part of a bottom hole assembly (BHA). The BHA may be used to drill the well 106. The downhole equipment 108 may communicate information to the equipment 104 at the surface, and may receive instructions and information from the surface equipment 104 as well. The surface equipment 104 and the downhole equipment 108 may communicate using various communications techniques, such as mud-pulse telemetry, electromagnetic (EM) telemetry, or others depending on the equipment and technology in use for the drilling operation.

The surface equipment 104 may also include communications means to communicate over a network 110 to remote computing devices 112. For example, the surface equipment 104 may communicate data using a satellite network to computing devices 112 supporting a remote team monitoring and assisting in the creation of the well 106 and other wells in other locations. Depending on the communications infrastructure available at the wellsite, various communications equipment and techniques (cellular, satellite, wired Internet connection, etc.) may be used to communicate data from the surface equipment 104 to the remote computing devices 112. In some embodiments, the surface equipment 104 sends data from measurements taken at the surface and measurements taken downhole by the downhole equipment 108 to the remote computing devices 112.

During the well construction process, a variety of operations (such as cementing, wireline evaluation, testing, etc.) may also be conducted. In such embodiments, the data collected by tools and sensors and used for reasons such as reservoir characterization may also be collected and transmitted by the surface equipment 104.

In FIG. 1, the well 106 includes a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
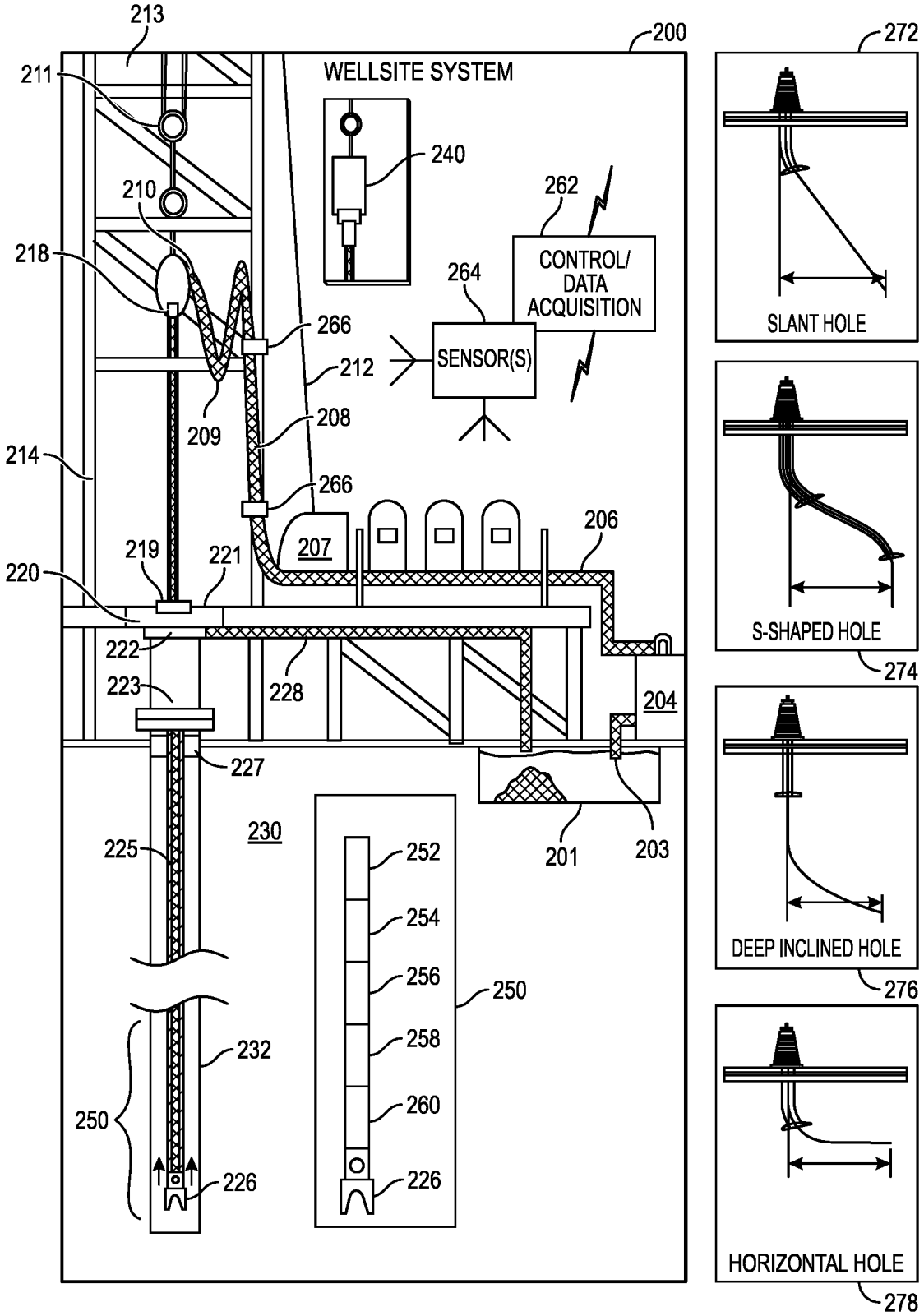
FIG. 2 illustrates an example of a drilling system that may be used to drill a well.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (sec, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borehole 232. As mentioned, the wellsite system 200 may include the rotary table 220 where the drillstring 225 pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may be modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and to thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to a RSS, it involves technology utilized for directional drilling. Directional drilling involves drilling into the Earth to form a deviated bore such that the wellbore path of the bore is not vertical; rather, the wellbore path deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface. In such an example, a bit RPM may be determined or estimated based on the RPM of the mud motor.

A RSS may drill directionally where there is continuous rotation from surface equipment, which may alleviate the sliding of a steerable motor (e.g., a PDM). A RSS may be deployed when drilling directionally (e.g., deviated, horizontal, or extended-reach wells). A RSS may aim to minimize interaction with a borehole wall, which may help to preserve borehole quality. A RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools. It will also be understood that more than one LWD and/or MWD module may be employed, for example, as represented at by the module 256 of the drillstring assembly 250. Where the position of an LWD module is mentioned, as an example, it may refer to a module at the position of the LWD module 254, the module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD tool 254 may include equipment for generating electrical power, for example, to power various components of the drillstring 225. As an example, the MWD tool 254 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and include equipment to perform method such as geosteering. As mentioned, a steerable system may be or include an RSS. As an example, a steerable system may include a PDM or of a turbine on a lower part of a drillstring which, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a wellbore path, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that may not be rotated or moved axially. As an example, a condition referred to as "differential sticking" may be a condition whereby the drillstring may not be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Figure 3:
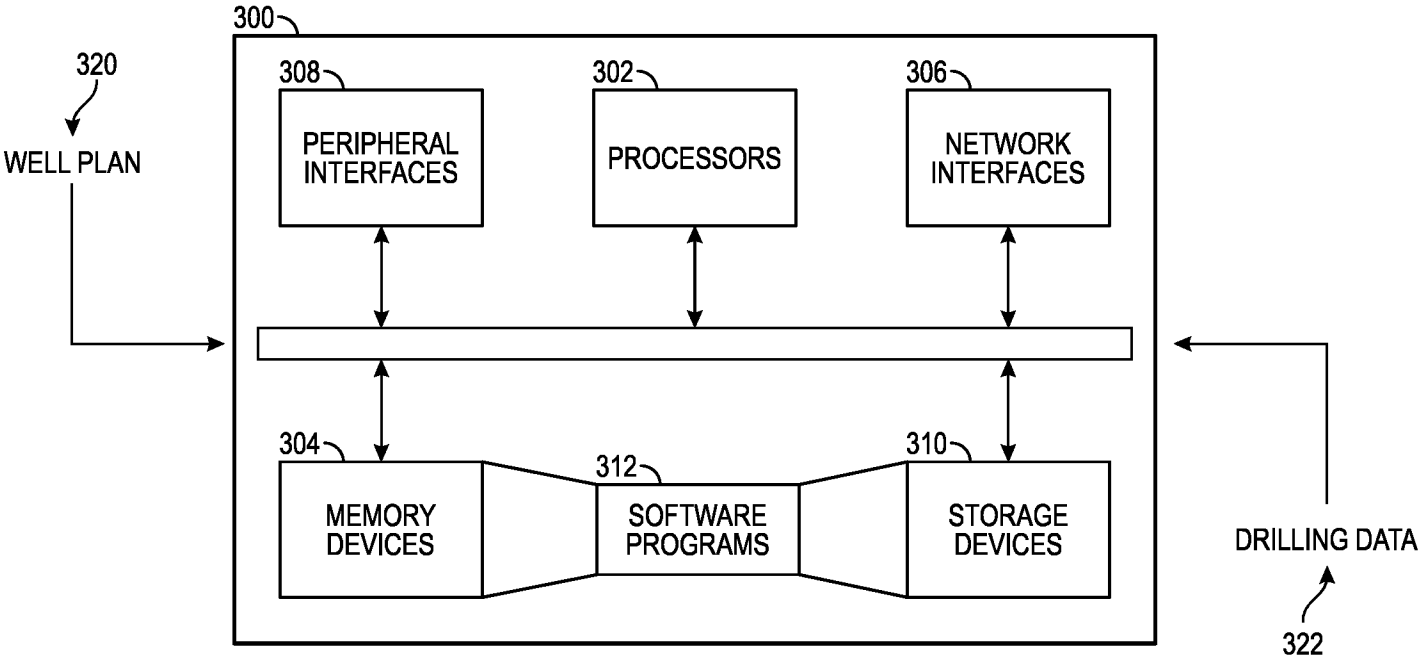
FIG. 3 illustrates an example computing system that may be used in connection with the drilling system.

FIG. 3 illustrates a schematic view of such a computing or processor system 300, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc. such as flash drives, hard drives, disks, random access memory, etc., for storing data, such as images, files, and program instructions for execution by the processor 302. In an embodiment, the computer-readable media 304 may store instructions that, when executed by the processor 302, are configured to cause the processor system 300 to perform operations. For example, execution of such instructions may cause the processor system 300 to implement one or more portions and/or embodiments of the method(s) described above.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

As an example, information may be input from a display (e.g., a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

The memory device 304 may be physically or logically arranged or configured to store data on one or more storage devices 310. The storage device 310 may include one or more file systems or databases in any suitable format. The storage device 310 may also include one or more software programs 312, which may contain interpretable or executable instructions for performing one or more of the disclosed processes. When requested by the processor 302, one or more of the software programs 312, or a portion thereof, may be loaded from the storage devices 310 to the memory devices 304 for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320. As discussed above, a well plan is to the description of the proposed wellbore to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan will also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as weight on bit (WOB), rate of penetration (ROP), torque, or others), text information entered by individuals working at the wellsite, or other data collected during the construction of the well.

In one embodiment, the processor system 300 is part of a rig control system (RCS) for the rig. In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

In one embodiment, the approach involves generating a three-dimensional map of wells in a geographic area. The process may involve obtaining the location of the wells in the geographic area. The location information includes the position of the wells in x and y space, as well as depth information for the wells. The x, y position may be expressed as latitude and longitude, distances from an specified point or location, or other location or coordinate system that may express the position of the well at the surface and in the subsurface. The position may come from survey data, public records, or other sources.

The approach may also involve generating a three-dimensional grid representing locations in the geographic area in the x, y dimensions and the z (or depth) dimension. The size of the grid representing the geographic area may be selected based on the size of the area being modeled. In one embodiment, the geographic area is a field. In another, the geographic area is manually configured. In another embodiment, the geographic area is sized based on the positions of the well that are selected to be included in the grid representing the geographic area.

In one embodiment, a depth to which the grid should extend is selected, and a starting depth is selected. The grid may be divided into one or more depth layers in the z dimension where the layers represent different layers from the starting depth to the target. The grid may also be partitioned into a plurality of cubes in the x, y dimensions such that the grid is composed of different elements representing particular depths and x, y positions.

The existing wells may be mapped onto the grid to create a three dimensional representation of the subsurface and the space occupied by the existing wells. In one embodiment, the mapping is done for each element or cell of the grid. The cells may be mapped to information indicating the certainty that there is an existing well at that particular cell. In one embodiment, the mapping accounts for appropriate uncertainty factors. For example, the presence of a well may be represented as a percentage certainty. For example, an adjacent cell may represent a spot 5 meters away from the reported position of the well at the particular depth. Depending on the granularity or resolution of the survey from which that data is taken, there may be a non-zero probability that the well (or a portion thereof) is actually located in the adjacent cell. The adjacent cell may be given a value (a percentage or other) to represent that non-zero probability.

In another embodiment, cells for which there is a threshold level of certainty that the well is located at that cell are also assigned a direction representing the direction of the wellbore at that cell.

In one embodiment, using the three-dimensional map, a topology group of the 3D grid is created that represents the available space within the geographic area. The topology may be a homology group or the fundamental group, which is the first homology group of a topological space or volume. This application primarily uses the terms topology and homology. This may then be used when planning paths for new wells and this may allow the designers to reduce the risk of collision quickly and easily.

The approach may also involve a process for planning a wellbore path (such as a re-entry wellbore path). The approach may involve obtaining one or more candidate starting locations for the reentry wellbore path. As discussed above, this starting location may be a surface location, a tie-in location, or other. The approach may also include obtaining one or more candidate targets for the reentry. The candidate targets represent one or more locations where the wellbore path should terminate within the subsurface.

The approach may also include obtaining one or more placement rules for the wellbore path. The placement rules are one or more rules that limit the locations where the planned wellbore path may be situated. For example, the placement rule may specify that a wellbore path may not be planned to come within a specified distance of an existing well. Placement rules may specify limits on wellbore tortuosity or the path of the wellbore path to prevent problems while drilling or afterwards.

The approach may also consider optimization for the wellbore path being planned. For example, the designer may specify one or more parameters such as cost, or time, carbon footprint, or other parameter to minimize. Other parameters may be selected to maximize.

The system may then use the three-dimensional grid of existing wells to generate one or more paths that avoid collisions with existing wells and satisfy one or more of the placement rules. In one embodiment, the system may present a plurality of candidate paths that satisfy the constraints but with different optimizations. For example, the system may generate the most cost-effective wellbore path, the fastest wellbore path, and the lowest carbon footprint wellbore path and present the paths to the user. The user may then select the wellbore path that best suits the requirements of the project.

In another embodiment, the system also allows the user to select the candidate wellbore path and edit the wellbore path at one or more points. During the editing process, the system may advise as to whether the edits will result in a collision or failure to satisfy one or more of the specified rules. In another embodiment, the system presents a visual representation of the grid and shows the positions of the existing wells relative to the planned wellbore path. The system may display a subset of the existing wells and may only present those that are relevant to the wellbore path.

In another embodiment, the system displays the topology such that the designer may see the cells where the designer may situate the planned wellbore path while satisfying the anti-collision and other requirements. The topology may include visual representations of the wells.

As discussed above, the workflow may be configured to automate re-entry well wellbore path design employing a topology viewpoint. The underground space with pre-existing wellbores may be pre-processed into a database of grids with labels. That is, the whole subsurface may be divided into a few layers in the vertical direction, where each layer is gridded and labeled according to a numeric index on if there is a wellbore and what direction is the wellbore. Such grids may define a topology representation of each layer. Connected free paths in the layer may make a candidate group. Unions of groups from the top through each layer will generate the full set of all candidate path in the terms of topology equality. These groups may be stored in a database. Given a tie-in position and a target, optimized path candidates may be computed on the fly according to specific anti-collision rules and other drilling constraints.

Figure 4:
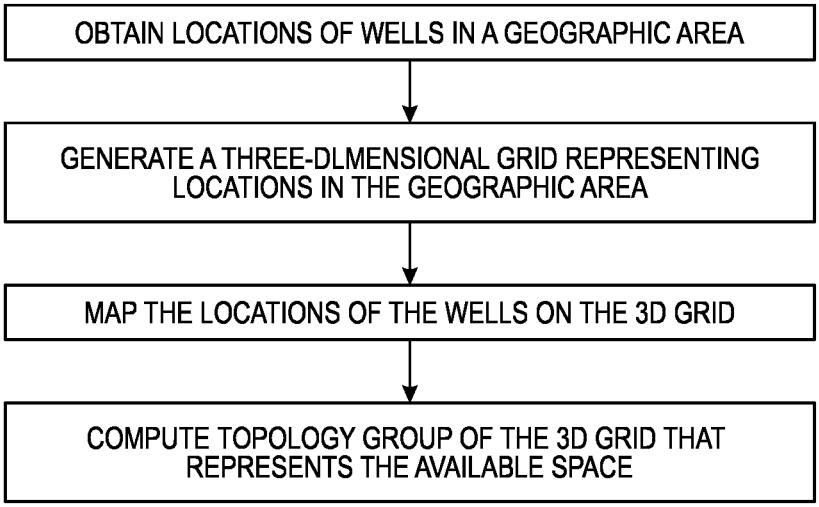
FIG. 4 illustrates a flowchart of a method for generating a 3D grid of a geographic space.

FIG. 4 illustrates one embodiment of a method for creating a 3D representation of wells in an area. The method may include comprising obtaining the locations of wells in a geographic area, generating a 3D grid representing locations in the geographic area, mapping the locations of the wells on the 3D grid, and computing the homology group of the 3D grid that represents the available space in the geographic area.

Figure 5:
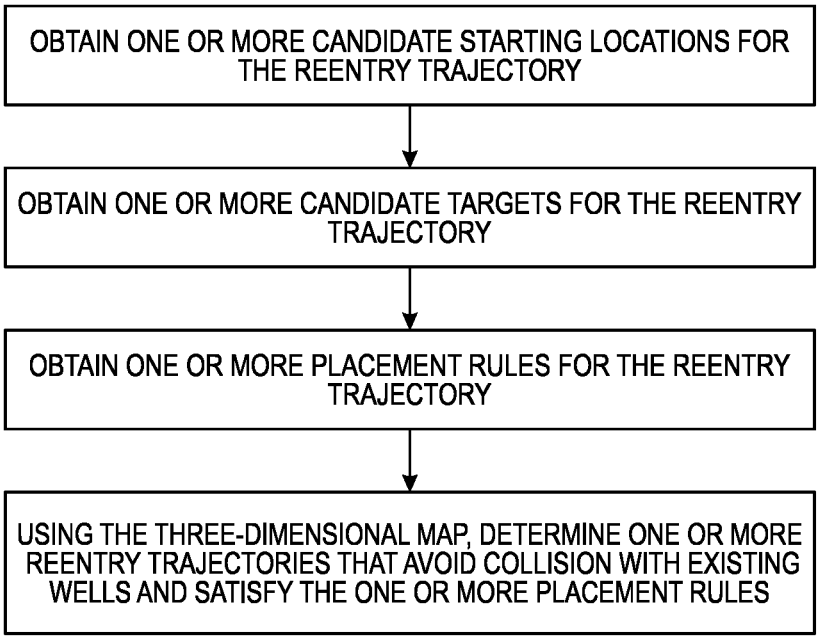
FIG. 5 illustrates a flowchart of a method for generating one or more candidate paths using a 3D grid map of the geographic space.

FIG. 5 illustrates an embodiment of a method for planning a wellbore path using a 3D representation of wells in an area. The method may include obtaining one or more candidate starting locations for a re-entry wellbore path and one or more candidate targets for the re-entry wellbore path. The method may also involve obtaining one or more placement rules for the reentry wellbore path. Using the three-dimensional map, the approach may involve determining one or more reentry paths that avoid collision with existing wells and that satisfy one or more placement rules for the wellbore path.

A wellsite action may be or may include generating and/or transmitting a signal (e.g., using a computing system) that causes a physical action to occur at a wellsite. The wellsite action may also or instead include performing the physical action at the wellsite. The physical action may include selecting where to drill a wellbore, drilling the wellbore, varying a weight and/or torque on a drill bit that is drilling the wellbore, varying a drilling wellbore path of the wellbore, varying a concentration and/or flow rate of a fluid pumped into the wellbore, or the like.

Figure 6:
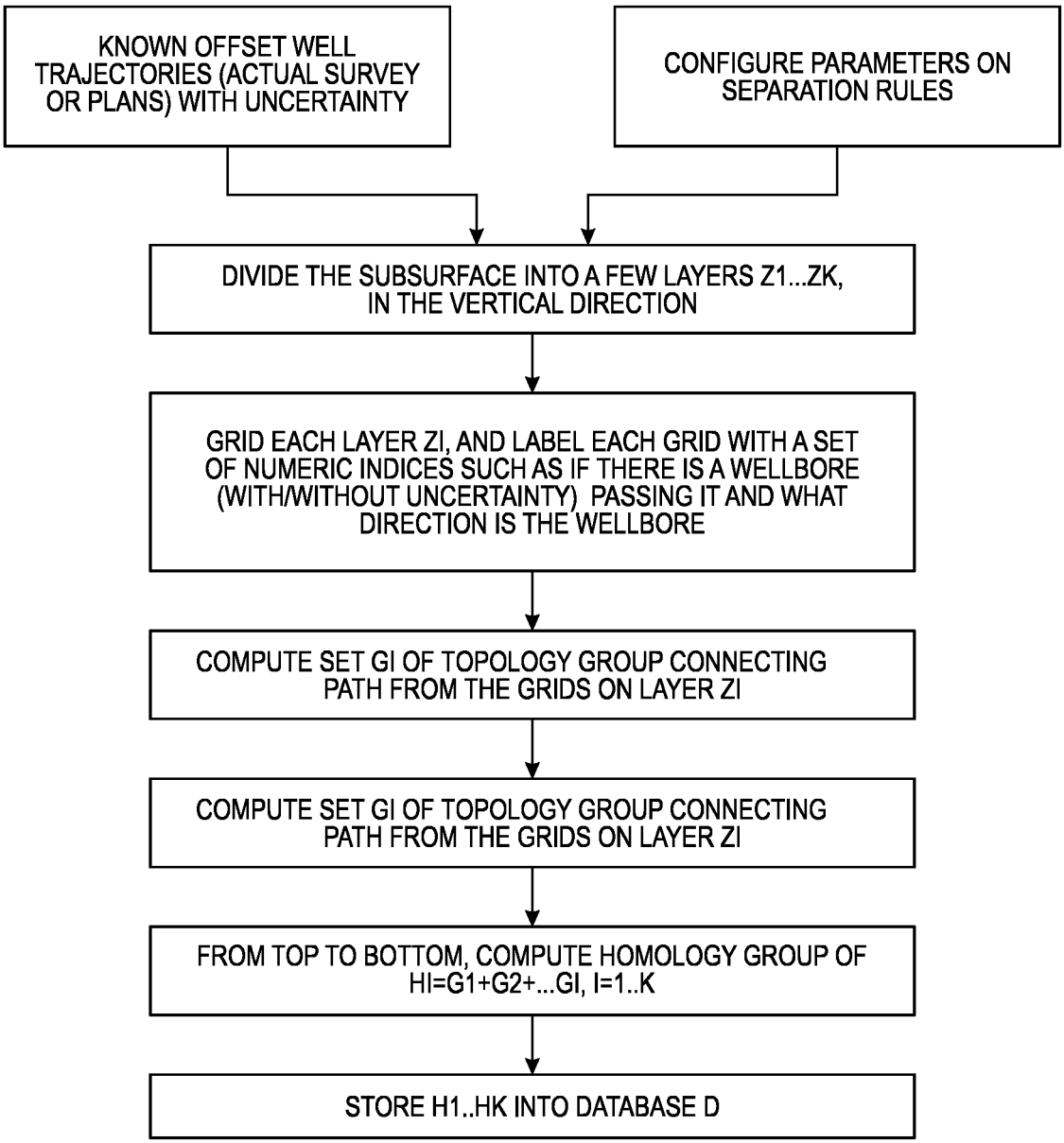
FIG. 6 illustrates a flowchart of a method for generating a homology group representing the geographic space.

FIG. 6 illustrates another method for generating a 3D map of a geographic area for use in planning well paths. The method may involve obtaining known offset well paths (whether from surveys, plans or other data sources) and associated uncertainty. The method may also involve configuring one or more parameters for separation rules for the planned wellbore path.

The method may also involve dividing the subsurface into layers in a vertical direction. The method may involve gridding each layer and labeling the grid with numeric indices such as if there is a wellbore (either with or without uncertainties) passing it and the direction of the wellbore. The method may involve computing a set of fundamental groups connecting paths from the grids on the layers and computing homology of the group of Hi=G1+G2+ . . . Gi. The homology Hi . . . Hk may be stored in a data structure such as a database.

Figure 7:
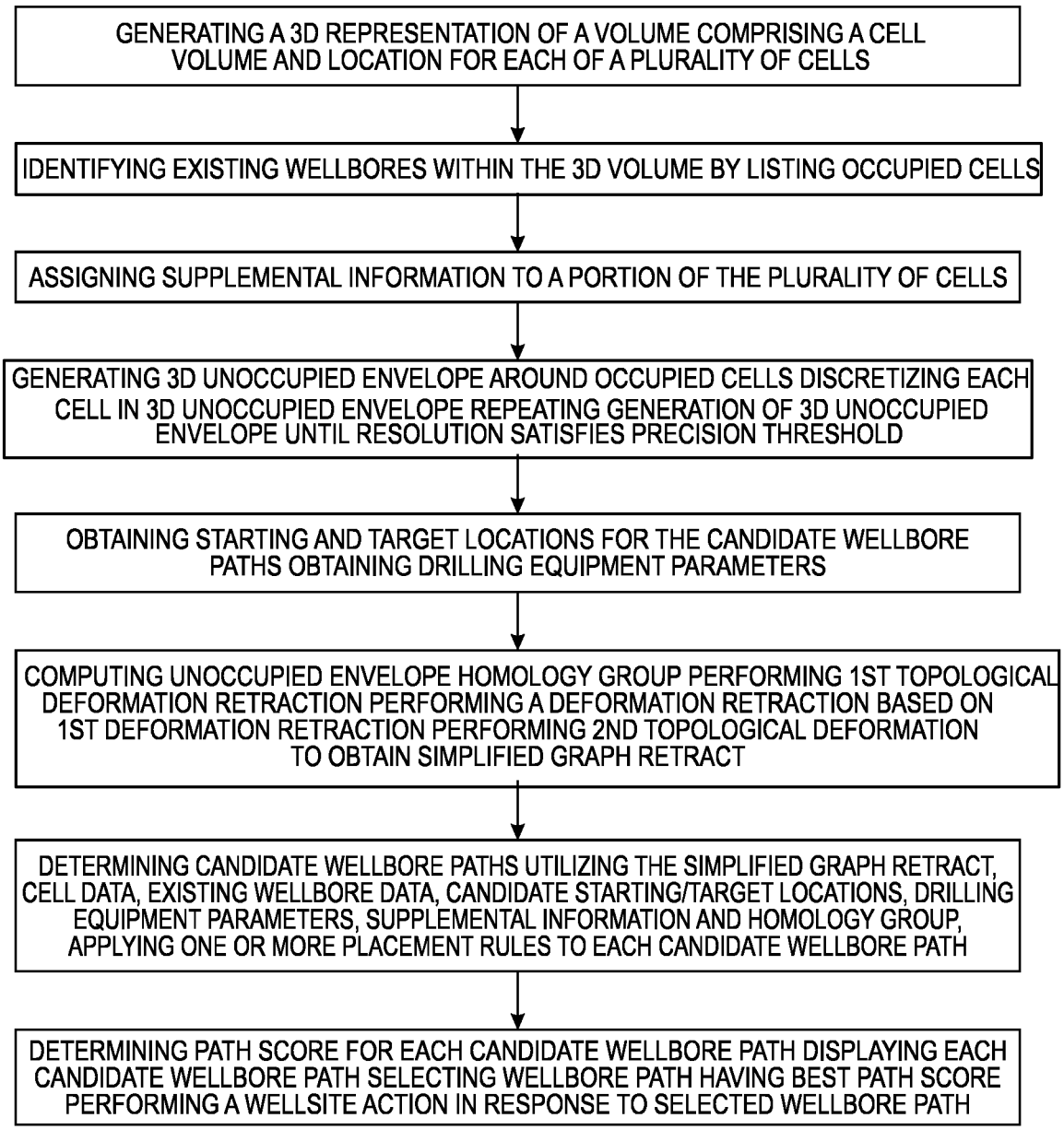
FIG. 7 illustrates a flowchart of a method for utilizing a homology group representing the geographic space in generating one or more candidate wellbore paths using a 3D volume.

FIG. 7 illustrates an embodiment of a method for planning a wellbore path using a 3D representation a plurality of cells and data regarding wells in an area, i.e., existing wellbores. The method may include assigning supplemental information to a portion of the plurality of cells. A 3D unoccupied envelope around the occupied cells with an initial size of cells is generated and modified by discretizing each cell and repeating the generation of the 3D save envelope with the reset resolution until a predetermined precision threshold is met. Additionally, one or more candidate starting locations for a re-entry wellbore path and one or more candidate targets for the re-entry wellbore path are obtained. A set of drilling equipment parameters may also be obtained. An unoccupied envelope homology group may also be generated from the plurality of cells and existing wellbore data. The unoccupied envelope homology group is used in preforming a first topological deformation retraction and a deformation of the unoccupied envelope 3D volume. A second topological deformation retraction to obtain a simplified graph retract configured to be mapped back to the 3D volume. The method involves determining one or more wellbore paths that avoid collision with existing wells and that satisfy one or more placement rules for the wellbore path. The method may also involve obtaining one or more placement rules for each wellbore path and determining a path score for each candidate wellbore path, displaying wellbore paths and the associated path score. A highest path score may be used in performing a wellsite action in response to the selected candidate wellbore path.

Implementation of the placement rules may involve an assessment of how well a particular rule is met by a particular candidate wellbore path. This assessment may be accorded a certain 'score' on this same basis. Other factors relevant to a particular candidate wellbore path may also be accorded scores. For example, each uncertainty value related to cells unoccupied by existing wellbores may be assigned a score as can the overall length of a candidate well bore. Essentially any parameter relevant to drilling a candidate well bore, whether based on the equipment being used or the geology through which the well bore passes, may be scored. All or some pertinent subset of these parameters may have their scores summed for each candidate wellbore and the highest of these scores may be used to select the 'best' candidate wellbore.

CONCLUSION

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

The claims that follow do not invoke section 112(f) unless the phrase "means for" is expressly used together with an associated function.

What is claimed is:

1. A method, comprising:

generating a representation of a three-dimensional (3D) volume comprising a plurality of cells, a portion of the 3D volume being below a ground surface, each of the plurality of cells having an associated depth parameter and two-dimensional grid location parameters;

identifying one or more existing wellbores within the 3D volume by listing cells, among the plurality of cells in the 3D volume, that are associated with the one or more existing wellbores as being occupied;

computing a 3D unoccupied envelope, the 3D unoccupied envelope comprising the plurality of cells in the 3D volume, excluding the occupied cells;

performing one or more topological deformation retractions of the 3D unoccupied envelope to determine a two-dimensional (2D) unoccupied envelope;

determining one or more candidate wellbore paths within the 2D unoccupied envelope; and starting one or more new wellbores respectively corresponding to the determined one or more candidate wellbore paths to avoid collision with the one or more existing wellbores.

2. The method of claim 1, wherein:

the generating the 3D volume includes recording data for each cell of the plurality of cells, the data comprising a cell volume and a unique location of each cell within the 3D volume designated by three location parameters;

one of the three location parameters comprises the associated depth parameter and represents a depth layer relative to the ground surface; and the other two of the three location parameters comprise the two-dimensional grid location parameters and define a grid that divides the depth layer into two-dimensional pieces.

3. The method of claim 1, further comprising:

applying one or more placement rules to each of the one or more candidate wellbore paths;

determining, for each of the one or more candidate wellbore paths, a path score based on the placement rules;

displaying each of the one or more candidate wellbore paths and each corresponding path score;

selecting a highest-score candidate wellbore path having a highest path score among the one or more candidate wellbore paths; and performing a wellsite action in response to the selected highest-score candidate wellbore path.

4. The method of claim 1, further comprising:

determining a simplified graph retract based at least partially on the 2D unoccupied envelope, wherein the simplified graph retract is configured to be mapped back to the 3D volume, and wherein the one or more candidate wellbore paths are determined using the simplified graph retract.

5. The method of claim 1, further comprising drilling the one or more new wellbores respectively along the determined one or more candidate wellbore paths to a corresponding candidate target location.

6. A method, comprising:

drilling one or more first wellbores in a reservoir;

generating a representation of a three-dimensional (3D) volume of the reservoir, the 3D volume comprising a plurality of cells, a portion of the 3D volume being below a ground surface, data for each cell of the plurality of cells comprising a cell volume and a unique location of each cell within the 3D volume designated by three location parameters, one of the three location parameters representing a depth layer relative to the ground surface, the other two of the three location parameters defining a grid that divides the depth layer into two-dimensional (2D) pieces;

identifying the one or more first wellbores within the 3D volume by listing cells, among the plurality of cells in the 3D volume, that are associated with the one or more first wellbores as being occupied;

computing a 3D unoccupied envelope, the 3D unoccupied envelope comprising the plurality of cells in the 3D volume, excluding the occupied cells;

performing a first topological deformation retraction to find a 2D unoccupied envelope in a 2D space corresponding to the 3D unoccupied envelope in the 3D volume;

performing a deformation retraction of the 3D unoccupied envelope;

performing a second topological deformation retraction to determine a simplified 2D graph retract configured to be mapped back to the 3D volume;

determining one or more candidate wellbore paths within the simplified graph retract that avoid collision with the one or more first wellbores; and drilling one or more second wellbores respectively corresponding to the determined one or more candidate wellbore paths to avoid collision with the one or more first wellbores.

7. The method of claim 6, wherein:

the identifying the one or more first wellbores by listing occupied cells includes listing the unique location of the occupied cell, a wellbore direction of the occupied cell, and an uncertainty value of cells adjacent to the occupied cell; and the computing the 3D unoccupied envelope includes excluding, from the 3D unoccupied envelope, cells having the uncertainty value being above a threshold uncertainty value.

8. The method of claim 7, further comprising:

assigning supplemental information to a portion of the plurality of cells in the 3D volume, wherein the supplemental information includes at least one of: geological layer information, geological composition information, geological feature information, reservoir information, reservoir adjacent information, petrophysical feature information, geo-mechanical feature information, or steering tendency feature information.

9. The method of claim 8, further comprising:

obtaining one or more candidate starting locations for a candidate wellbore path; and obtaining one or more candidate target locations for the candidate wellbore path, wherein the candidate starting locations and the candidate target locations are:

static when determining the candidate wellbore paths, or dynamic in real-time when determining the candidate wellbore paths.

10. The method of claim 9, wherein the performing the first topological deformation retraction further comprises utilizing, for the first topological deformation retraction, the 3D unoccupied envelope, data for the cells, first wellbore identification, candidate starting location, candidate target location, and supplemental information.

11. The method of claim 10, wherein:

the determining the candidate wellbore paths includes applying one or more placement rules to each of the candidate wellbore paths; and the method further comprises:

determining a path score for each of the candidate wellbore paths;

selecting a highest-score candidate wellbore path having a highest path score among the candidate wellbore paths; and performing a wellsite action in response to the selected highest-score candidate wellbore path.

12. The method of claim 6, further comprising:

obtaining a set of drilling equipment parameters comprising downhole steering tool parameters, drilling assembly parameters, and steering tendency capacity parameters, wherein the determining the candidate wellbore paths includes utilizing at least one of the drilling equipment parameters.

13. The method of claim 6, wherein:

the determining the candidate wellbore paths includes applying one or more placement rules to each of the candidate wellbore paths; and the method further comprises:

determining a path score for each of the candidate wellbore paths;

selecting a highest-score candidate wellbore path having a highest path score among the candidate wellbore paths; and performing a wellsite action in response to the selected highest-score candidate wellbore path.

14. The method of claim 6, further comprising drilling each of the one or more second wellbores respectively along the determined one or more candidate wellbore paths to a corresponding candidate target location.

15. A method for drilling one or more new wellbores in a reservoir in which one or more existing wellbores are located, the method comprising:

generating a three-dimensional (3D) representation of a 3D volume, a portion of the 3D volume being below a ground surface of the reservoir, the 3D volume comprising a plurality of cells, data for each cell of the plurality of cells comprising a cell volume and a unique location of each cell within the 3D volume designated by three location parameters;

identifying the one or more existing wellbores within the 3D volume by listing cells, among the plurality of cells in the 3D volume, that are associated with the one or more existing wellbores as being occupied;

assigning supplemental information to a portion of the plurality of cells in the 3D volume;

generating a 3D unoccupied envelope around comprising the plurality of cells, excluding the occupied cells, each of the plurality of cells having an initial size;

discretizing each cell in the 3D unoccupied envelope into a set of cell sizes each having a discretized cell size smaller than the initial size;

repeating the generation of the 3D unoccupied envelope and the discretizing, with a previous discretized cell size being set as the initial size for each repeating, until a resolution of the 3D unoccupied envelope reaches a predetermined precision threshold as a threshold-resolution 3D unoccupied envelope;

performing a first topological deformation retraction to find a two-dimensional (2D) unoccupied envelope comprising a plurality of 2D cells in a 2D space corresponding to the threshold-resolution 3D unoccupied envelope;

performing a deformation retraction of the threshold-resolution 3D unoccupied envelope of the 3D volume based on the first topological deformation retraction;

performing a second topological deformation retraction to obtain a simplified 2D graph retract that is configured to be mapped back to the 3D volume;

determining one or more candidate wellbore paths within the 2D graph retract that avoid collision with the one or more existing wellbores, utilizing at least one of the simplified graph retract, data for the cells, existing wellbore data, candidate starting locations, candidate target locations, drilling equipment parameters, supplemental information, and the threshold-resolution 3D unoccupied envelope; and starting the one or more new wellbores respectively corresponding to the determined one or more candidate wellbore paths to avoid collision with the one or more existing wellbores.

16. The method of claim 15, wherein a set of input data to the first topological deformation retraction includes at least one of: the data for the cells, the existing wellbore data, and the supplemental information.

17. The method of claim 16, further comprising:

obtaining one or more candidate starting locations for a candidate wellbore path;

obtaining one or more candidate target locations for the candidate wellbore path; and computing a 3D unoccupied envelope comprising a list of cell locations, wherein the 3D unoccupied envelope comprises either:

the plurality of cells in the 3D volume other than the occupied cells, or the plurality of cells in the 3D volume having an uncertainty value below a threshold uncertainty, and wherein the set of input data to the first topological deformation retraction includes at least one of: the candidate starting location, the candidate target location, or the 3D unoccupied envelope.

18. The method of claim 15, further comprising drilling the one or more new wellbores respectively along the determined one or more candidate wellbore paths to a corresponding candidate target location.

* * * * *